US009551337B2

(12) United States Patent
Kokubu et al.

(10) Patent No.: US 9,551,337 B2
(45) Date of Patent: Jan. 24, 2017

(54) ELECTROMAGNETIC PUMP

(75) Inventors: Takahiro Kokubu, Nishio (JP); Masaya Nakai, Tokoname (JP); Kota Fukao, Ichinomiya (JP); Noriomi Fujii, Toyota (JP)

(73) Assignee: Aisin AW Co., LTD, Anjo (JP)

( * ) Notice: Subject to any disclaimer, the term of this patent is extended or adjusted under 35 U.S.C. 154(b) by 471 days.

(21) Appl. No.: 14/124,060

(22) PCT Filed: Jul. 23, 2012

(86) PCT No.: PCT/JP2012/068561
§ 371 (c)(1),
(2), (4) Date: Dec. 5, 2013

(87) PCT Pub. No.: WO2013/031426
PCT Pub. Date: Mar. 7, 2013

(65) Prior Publication Data

US 2014/0099219 A1 Apr. 10, 2014

(30) Foreign Application Priority Data

Aug. 31, 2011 (JP) ..... 2011-189972

(51) Int. Cl.
*F04B 53/12* (2006.01)
*F04B 17/04* (2006.01)
(Continued)

(52) U.S. Cl.
CPC ..... *F04B 53/126* (2013.01); *F04B 17/04* (2013.01); *F04B 17/044* (2013.01);
(Continued)

(58) Field of Classification Search
CPC ... F04B 17/044; F04B 17/046; F04B 53/1002; F04B 53/126; F04B 3/00; F04B 3/003; F04B 39/0016; F04B 53/12; F04B 53/121; F04B 53/122; F04B 17/042; F04B 17/04
(Continued)

(56) References Cited

U.S. PATENT DOCUMENTS 2,764,098 A 9/1956 Dickey et al.
5,540,570 A 7/1996 Schuller et al.
(Continued)

FOREIGN PATENT DOCUMENTS

DE 293 176 A5 8/1991
DE 43 29 211 B4 12/2005
(Continued)

OTHER PUBLICATIONS

International Search Report issued in International Patent Application No. PCT/JP2012/068561 dated Oct. 16, 2012.

*Primary Examiner* — Dominick L Plakkoottam
(74) *Attorney, Agent, or Firm* — Oliff PLC

(57) ABSTRACT

An electromagnetic pump including a piston, an electromagnetic portion that moves the piston forward, and a spring that moves the piston backward. The piston including a discharge check valve built in the piston. The piston is formed with a hollow portion that opens in an inner peripheral portion of an end surface of the piston, and a spring receiving surface formed on an outer peripheral portion of the end surface to receive the spring. The discharge check valve is fixed through plastic deformation of the piston by inserting the discharge check valve into the hollow portion from an opening of the piston, and partially pressing a portion of the spring receiving surface of the piston on an inner peripheral side after the insertion to recess the spring receiving surface and elevate an inner peripheral surface of the piston surrounding the hollow portion.

15 Claims, 7 Drawing Sheets

(51) Int. Cl.
*F04B 39/00* (2006.01)
*F04B 53/10* (2006.01)

(52) U.S. Cl.
CPC ..... *F04B 17/046* (2013.01); *F04B 39/0016* (2013.01); *F04B 53/1002* (2013.01); *F04B 53/12* (2013.01); *F04B 17/042* (2013.01)

(58) Field of Classification Search
USPC ..... 417/259; 92/183
See application file for complete search history.

(56) References Cited

U.S. PATENT DOCUMENTS

| | | | | |
|---|---|---|---|---|
| 5,562,430 | A | 10/1996 | Schuller et al. | |
| 6,093,003 | A | 7/2000 | Hauser et al. | |
| 6,341,950 | B1 | 1/2002 | Schuller et al. | |
| 6,431,051 | B1 * | 8/2002 | Stoppek | B22F 3/22 92/157 |
| 8,491,287 | B2 * | 7/2013 | Murai | B60T 8/4031 417/545 |
| 2007/0261931 | A1 | 11/2007 | Beck | |
| 2009/0293978 | A1 * | 12/2009 | Lauterbach | F15B 1/04 138/31 |
| 2011/0293449 | A1 * | 12/2011 | Shimizu | F04B 17/044 417/415 |

FOREIGN PATENT DOCUMENTS

| | | | | |
|---|---|---|---|---|
| DE | 197 52 545 | B4 | 8/2006 | |
| DE | 10 2006 024 049 | A1 | 11/2007 | |
| DE | EP 1953430 | A1 * | 8/2008 | F16K 15/044 |
| EP | 1 953 430 | A1 | 8/2008 | |
| JP | U-54-31202 | | 3/1979 | |
| JP | A-2000-320670 | | 11/2000 | |
| JP | WO 2010146952 | A1 * | 12/2010 | F04B 17/044 |
| JP | A-2011-21593 | | 2/2011 | |
| WO | WO 2010/146952 | A1 | 12/2010 | |

* cited by examiner

ELECTROMAGNETIC PUMP

INCORPORATION BY REFERENCE

The disclosure of Japanese Patent Application No. 2011-189972 filed on Aug. 31, 2011 including the specification, drawings and abstract is incorporated herein by reference in its entirety.

BACKGROUND OF THE INVENTION

The present invention relates to an electromagnetic pump.

DESCRIPTION OF THE RELATED ART

Hitherto, there has been proposed an electromagnetic pump of this type, including: a cylinder; a piston that moves back and forth within the cylinder; an electromagnetic portion that moves the piston forward; a spring that moves the piston backward; a suction check valve that allows working oil to flow in one direction from a suction port to a pump chamber within the cylinder; and a discharge check valve that allows working oil to flow in one direction from the pump chamber to a discharge port, in which the discharge check valve is formed integrally with the piston and housed within the cylinder (see Japanese Patent Application Publication No. 2011-21593 (JP 2011-21593 A), for example). In the electromagnetic pump, the discharge check valve is composed of a main body having a hollow cylindrical shape in which a center hole is formed in the axial center and in which a through hole penetrates the center hole in the radial direction to communicate with the discharge port, a spring inserted with the bottom of the center hole serving as a spring receiver, a ball urged by the spring toward a pump chamber, and a plug having a hollow cylindrical shape, inserted into the center hole to communicate with the pump chamber, and formed with an opening portion to receive the ball. The discharge check valve is assembled by inserting the spring, the ball, and the plug into the center hole of the main body sequentially in this order, and thereafter attaching a snap ring to restrict movement of the plug.

SUMMARY OF THE INVENTION

The electromagnetic pump discussed above has been made smaller in size, and accordingly the discharge check valve housed within the cylinder also has been made smaller in size. Therefore, the snap ring is inevitably made smaller in size, which lowers the ease of assembly of the electromagnetic pump. In addition, the snap ring is used as a dedicated part that restricts movement of the plug, which increases the number of parts forming the discharge check valve.

It is a main object of the electromagnetic pump according to the present invention to further improve the ease of assembly by reducing the number of parts.

In order to achieve the foregoing main object, the electromagnetic pump according to the present invention adopts the following means.

According to an aspect of the present invention, an electromagnetic pump includes: a piston that moves back and forth within a cylinder; an electromagnetic portion that moves the piston forward; and a spring that moves the piston backward, the piston including a discharge check valve built in the piston, in which:

the piston is formed with a hollow portion that opens in an inner peripheral portion of an end surface of the piston, and a spring receiving surface formed on an outer peripheral portion of the end surface to receive the spring; and the discharge check valve is fixed through plastic deformation of the piston by inserting the discharge check valve into the hollow portion from an opening of the piston, and partially pressing a portion of the spring receiving surface of the piston on an inner peripheral side after the insertion to recess the spring receiving surface and elevate an inner peripheral surface of the piston surrounding the hollow portion.

In the electromagnetic pump according to the aspect, the discharge check valve is fixed through plastic deformation of the piston by inserting constituent members of the discharge check valve into the hollow portion from the opening of the piston, and partially pressing the portion of the spring receiving surface of the piston on the inner peripheral side after the insertion to recess the spring receiving surface and elevate the inner peripheral surface of the piston surrounding the hollow portion. This makes it possible to improve the ease of assembly compared to a configuration in which the discharge check valve is fixed using a relatively small member such as a snap ring. In addition, the number of parts can be reduced with no need for a dedicated fixing part. As a result, it is possible to further improve the ease of assembly by reducing the number of parts.

In the thus configured electromagnetic pump according to the aspect of the present invention, a portion of the spring receiving surface on the inner peripheral side with respect to a region against which the spring abuts may be pressed. This hinders the region which abuts against the spring from being recessed significantly, which prevents the function of the piston as a spring receiver from being affected.

In the electromagnetic pump according to the aspect of the present invention, in addition, the piston may be quenched except at an end portion of the piston having the end surface. This makes it possible to secure a necessary hardness for the piston, and to plastically deform the piston relatively easily. The quenching may be high-frequency quenching.

In the electromagnetic pump according to the present invention, further, the piston may be formed such that an outside diameter of an outer peripheral surface of the piston at a portion on an end surface side is smaller than an outside diameter that enables the piston to slide within the cylinder. This prevents an increase in sliding resistance between the piston and the cylinder even if the piston is expanded in outside diameter by the plastic deformation.

In the electromagnetic pump according to the aspect of the present invention, moreover, the cylinder may be formed such that an inside diameter of an inner peripheral surface of the cylinder at a portion that defines a range of movement of the end portion having the end surface of the piston is larger than an inside diameter that enables the piston to slide. This prevents an increase in sliding resistance between the piston and the cylinder even if the piston is expanded in outside diameter by the plastic deformation while preventing a reduction in size of the outer peripheral portion of the piston end surface which functions as a spring receiver.

In the electromagnetic pump according to the aspect of the present invention, furthermore, the piston may be formed with a cylindrical space that communicates with a discharge port as the hollow portion; the discharge check valve may include a ball, an annular plug formed with a flow-in port for a working fluid, and a second spring that presses the ball against the flow-in port of the plug in a direction opposite to a flow-in direction of the working fluid, which are inserted into the hollow portion of the piston in the order of the second spring, the ball, and the plug; and the inner peripheral surface surrounding the hollow portion may be elevated by the pressing to extend over the plug. In the electromagnetic pump according to this aspect of the present invention, the plug may be formed with a tapered surface that becomes gradually larger in outside diameter from an end surface toward an outer peripheral surface, and inserted into the hollow portion with the tapered surface facing toward the opening; and the inner peripheral surface surrounding the hollow portion may be elevated by the pressing to fill a gap between the inner peripheral surface and the tapered surface of the plug. This makes it possible to fix the discharge check valve more reliably with the elevated portion of the inner peripheral surface and the plug in tight contact with each other compared to a configuration in which the plug is not formed with the tapered surface. In the electromagnetic pump according to the above aspect of the present invention, in addition, the plug may be press-fitted into the hollow portion of the piston. This allows the discharge check valve to be fixed by the press-fitting and the elevation of the inner peripheral surface. Thus, it is possible to reliably fix the discharge check valve while suppressing deformation of the piston compared to a configuration in which the discharge check valve is fixed by only the elevation of the inner peripheral surface.

DETAILED DESCRIPTION OF THE EMBODIMENTS

An embodiment of the present invention will be described below.

Figure 1:
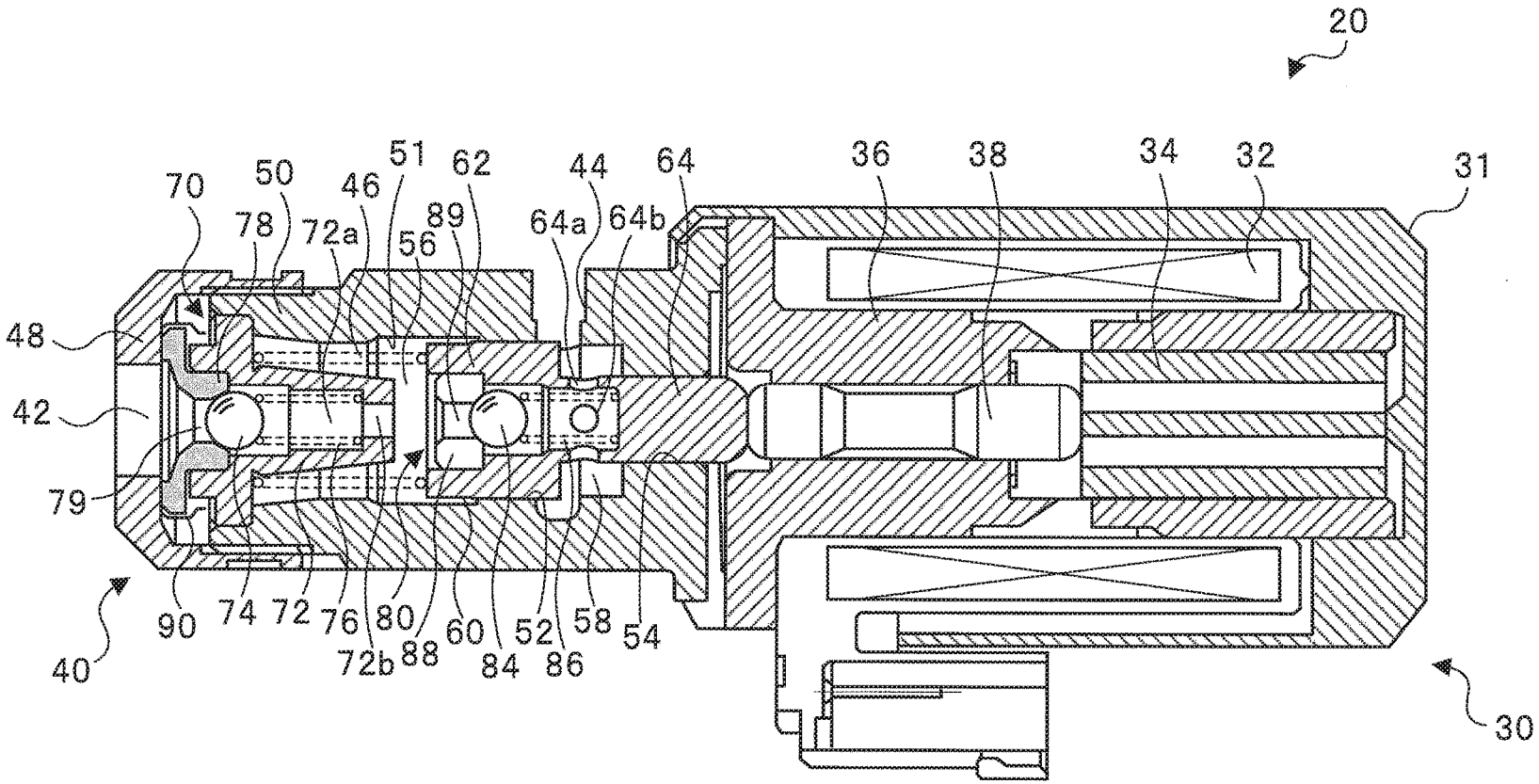
FIG. 1 is a diagram showing a schematic configuration of an electromagnetic pump 20 according to an embodiment of the present invention.
Figure 2:
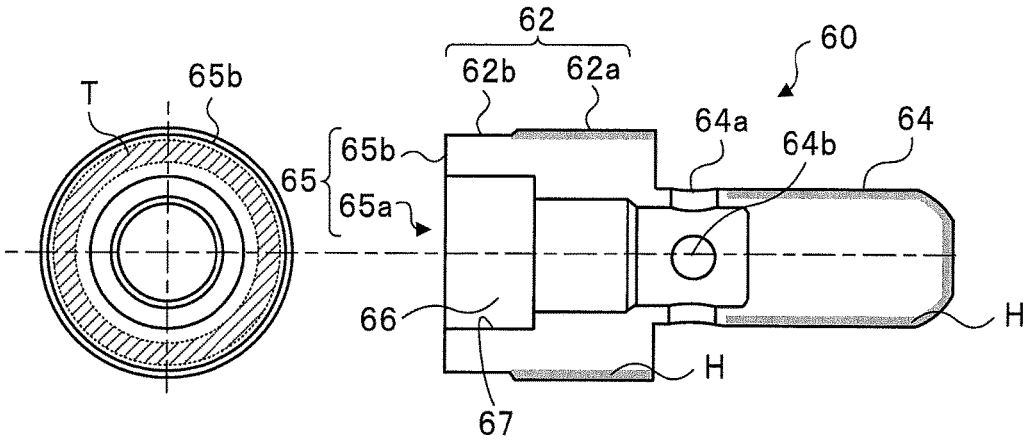
FIG. 2 is a diagram showing a schematic configuration of a piston 60 of the electromagnetic pump 20.

FIG. 1 is a diagram showing a schematic configuration of an electromagnetic pump 20 according to an embodiment of the present invention. FIG. 2 is a diagram showing a schematic configuration of a piston 60 of the electromagnetic pump 20. The electromagnetic pump 20 according to the embodiment includes a solenoid portion 30 that generates an electromagnetic force, and a pump portion 40 actuated by the electromagnetic force of the solenoid portion 30. The electromagnetic pump 20 may be formed as a part of a hydraulic control device provided in a vehicle incorporating an engine and an automatic transmission to hydraulically drive friction engagement elements (clutches and brakes) included in the automatic transmission.

The solenoid portion 30 includes a solenoid case 31 that is a bottomed cylindrical member, an electromagnetic coil 32, a plunger 34 that serves as a movable element, and a core 36 that serves as a stationary element. The electromagnetic coil 32, the plunger 34, and the core 36 are disposed in the solenoid case 31. In the solenoid portion 30, a current is applied to the electromagnetic coil 32 to form a magnetic circuit in which magnetic flux circulates through the solenoid case 31, the plunger 34, and the core 36, and the plunger 34 is attracted to push out a shaft 38 provided in abutment with the distal end of the plunger 34.

The pump portion 40 is formed as a piston pump that moves the piston 60 back and forth using the electromagnetic force from the solenoid portion 30 and the urging force of a spring 46 to pump working oil. The pump portion 40 includes: a cylinder 50 having a hollow cylindrical shape with its one end joined to the solenoid case 31 of the solenoid portion 30; the piston 60 slidably disposed within the cylinder 50 with its base end surface coaxially abutting against the distal end of the shaft 38 of the solenoid portion 30; the spring 46 that abuts against the distal-end surface of the piston 60 to urge the piston 60 in the direction opposite to the direction in which the electromagnetic force from the solenoid portion 30 is applied; a suction check valve 70 that supports the spring 46 from the side opposite to the distal-end surface of the piston 60, that permits working oil to flow in the direction of being sucked into a pump chamber 56, and that prohibits working oil to flow in the opposite direction; a strainer 90 disposed at the suction port of the suction check valve 70 to trap foreign matter such as dust contained in sucked working oil; a discharge check valve 80 that is built in the piston 60, that permits working oil to flow in the direction of being discharged from the pump chamber 56, and that prohibits working oil to flow in the opposite direction; and a cylinder cover 48 that covers the other end of the cylinder 50 with the piston 60, the discharge check valve 80, the spring 46, and the suction check valve 70 disposed inside the cylinder 50. In the pump portion 40, a suction port 42 is formed at the axial center of the cylinder cover 48, and a discharge port 44 is formed by cutting away a part of the side surface of the cylinder 50 in the circumferential direction.

The piston 60 is formed in a stepped shape with a piston main body 62 having a cylindrical shape, and a shaft portion 64 having a cylindrical shape with its end surface in abutment with the distal end of the shaft 38 of the solenoid portion 30 and being smaller in outside diameter than the piston main body 62. The piston 60 moves back and forth within the cylinder 50 in conjunction with the shaft 38 of the solenoid portion 30. The piston main body 62 includes a sliding portion 62*a* formed with an outside diameter that enables sliding with respect to the inner wall of the cylinder 50, and a distal-end portion 62*b* formed with an outside diameter that is slightly smaller than that of the sliding portion 62*a*. The distal-end portion 62*b* forms the distal end of the piston 60. In the piston 60, the center portion corresponding to the inner peripheral portion of an end surface 65 on the distal-end side is open (hereinafter referred to an "opening 65*a*"), and a bottomed hollow portion 66 with a cylindrical shape is formed at the axial center. The discharge check valve 80 is disposed in the hollow portion 66. The outer peripheral portion of the end surface 65 functions as a spring receiving surface 65*b* that receives the spring 46. A region of the spring receiving surface 65*b* that abuts against the spring 46 is referred to as an "abutment region T", and indicated by the oblique lines in FIG. 2. The hollow portion 66 is surrounded by an inner peripheral surface 67 of the piston 60, and extends through the inside of the piston main body 62 to a middle of a space inside the shaft portion 64. The shaft portion 64 is formed with two through holes 64*a* and 64*b* that intersect each other at an angle of 90 degrees in the radial direction. The discharge port 44 is formed around the shaft portion 64. The hollow portion 66 communicates with the discharge port 44 via the two through holes 64*a* and 64*b*. The piston 60 has been quenched to obtain a necessary hardness in order to secure durability and wear resistance. The quenched portions are indicated by H in FIG. 2. In the embodiment, as shown in the drawing, the quenching is performed through high-frequency quenching so that the sliding portion 62*a* and the shaft portion 64 are quenched but the distal-end portion 62*b* is not quenched.

Figure 3:
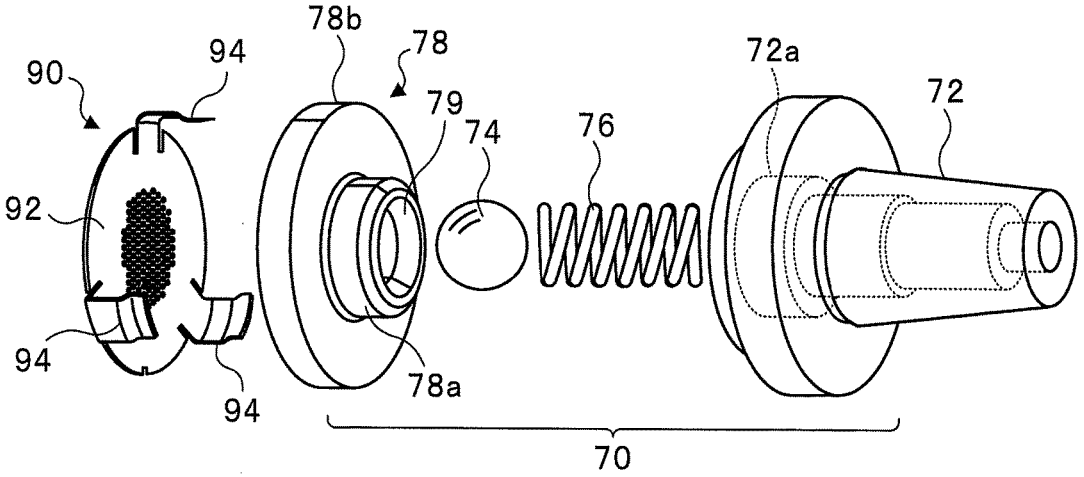
FIG. 3 is an illustration showing how a suction check valve 70 is assembled.
Figure 4:
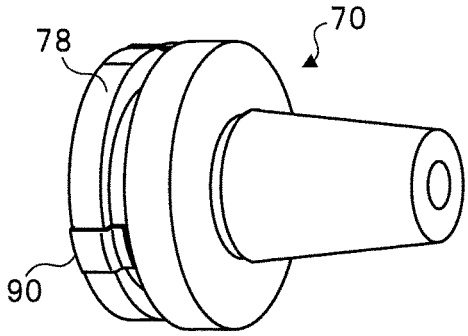
FIG. 4 shows the appearance of the suction check valve 70 after being assembled.

The suction check valve 70 includes a valve main body 72 fitted into the cylinder 50 and having a bottomed hollow portion 72*a* formed inside thereof and a center hole 72*b* formed at the axial center in the bottom of the hollow portion 72*a* to communicate between the hollow portion 72*a* and the pump chamber 56, a ball 74, a spring 76 that provides an urging force to the ball 74, and a plug 78 that serves as a seat portion for the ball 74 and that has a center hole 79 having an inside diameter that is smaller than the outside diameter of the ball 74. FIG. 3 illustrates how the suction check valve 70 is assembled. FIG. 4 shows the appearance of the suction check valve 70 after being assembled. As shown in the drawing, the suction check valve 70 is assembled by sequentially inserting the spring 76 and the ball 74 into the hollow portion 72*a* of the valve main body 72, and press-fitting the plug 78 into the hollow portion 72*a*. The plug 78 is formed as a flanged cylindrical member including a cylindrical portion 78*a* having an outside diameter that allows the plug 78 to be press-fitted into the hollow portion 72*a* of the valve main body 72, and a flange portion 78*b* that extends in the radial direction from the end edge of the cylindrical portion 78*a*. The strainer 90 is attached so as to cover the end surface of the flange portion 78*b*.

As shown in FIG. 3, the strainer 90 is composed of a disk portion 92, in the center region of which a large number of pores are formed to form a strainer surface, and three leg portions 94 which extend from the outer peripheral edge of the disk portion 92 in the orthogonal direction and at the distal end of which clips that are bent inward are provided. Therefore, when the leg portions 94 of the strainer 90 are placed over the flange portion 78*b* of the plug 78 as shown in FIG. 4, the clips at the distal end of the leg portions 94 are engaged with a stepped portion between the flange portion 78*b* and the cylindrical portion 78*a*, preventing the strainer 90 from slipping off. In the embodiment, the suction check valve 70 and the strainer 90 are assembled in this way to form a sub-assembly (see FIG. 4).

The suction check valve 70 opens with the spring 76 compressed and the ball 74 moved away from the center hole 79 of the plug 78 when the pressure difference (P1−P2) between the input-side pressure P1 and the output-side pressure P2 is equal to or more than a predetermined pressure to overcome the urging force of the spring 76. The suction check valve 70 closes with the spring 76 expanded and the ball 74 pressed against the center hole 79 of the plug 78 to block the center hole 79 when the pressure difference (P1−P2) discussed above is less than the predetermined pressure.

Figure 5:
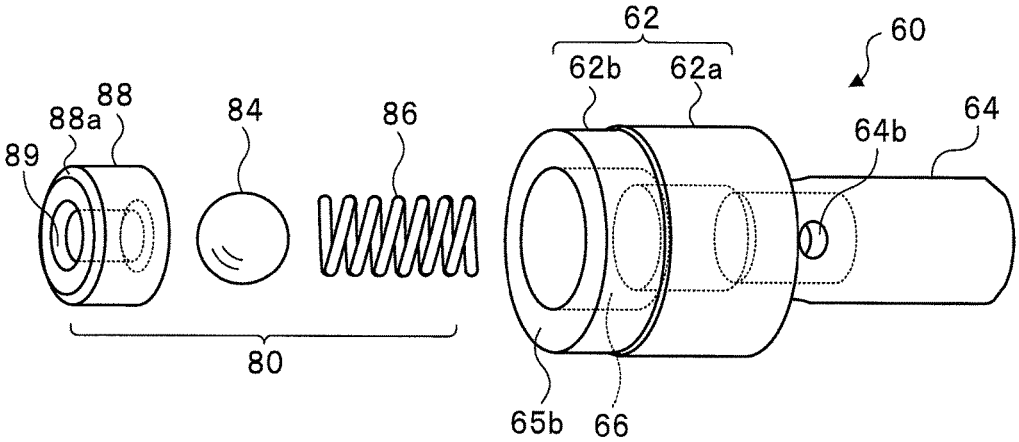
FIG. 5 is an illustration showing how constituent members of a discharge check valve 80 are inserted into a piston 60.

The discharge check valve 80 includes a ball 84, a spring 86 that provides an urging force to the ball 84, and a plug 88 formed as an annular member with a center hole 89 having an inside diameter that is smaller than the outside diameter of the ball 84. The plug 88 is formed such that its outside diameter is generally the same as the inside diameter of the hollow portion 66 (opening 65*a*) of the piston 60, and formed with a tapered surface 88*a* with its outside diameter becoming gradually larger from an end surface on one end side toward the outer peripheral surface of the plug 88. FIG. 5 is shows how constituent members of the discharge check valve 80 are inserted into the piston 60. As shown in the drawing, the discharge check valve 80 is inserted by inserting the spring 86 and the ball 44 sequentially in this order into the hollow portion 66 from the opening 65*a* of the piston 6, and press-fitting the plug 88 into the hollow portion 66 after the insertion with the tapered surface 88*a* facing toward the opening 65*a*. After the plug 88 is press-fitted into the hollow portion 66, further, the piston 60 is plastically deformed to fix the discharge check valve 80. The plastic deformation will be described below.

Figure 6:
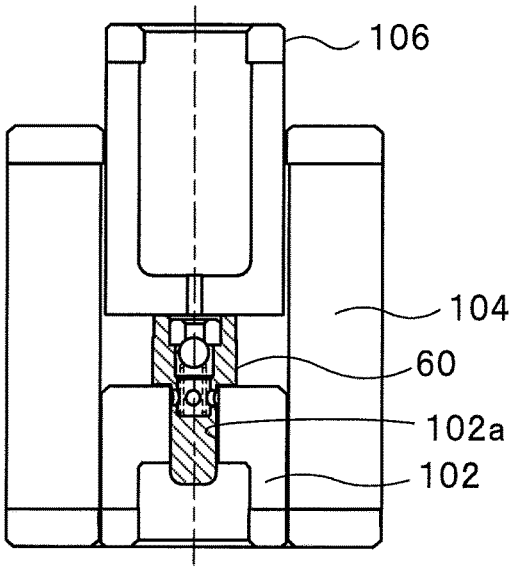
FIG. 6 is an illustration showing how the piston 60 is plastically deformed.
Figure 7:
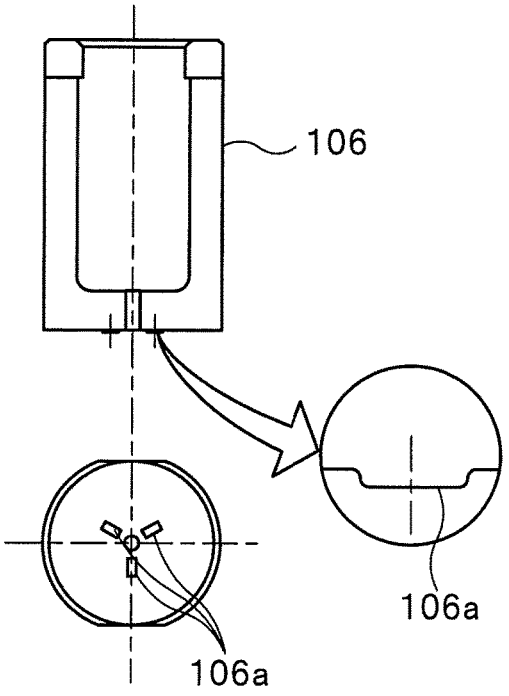
FIG. 7 is an illustration showing a schematic configuration of an upper die 106.
Figure 8:
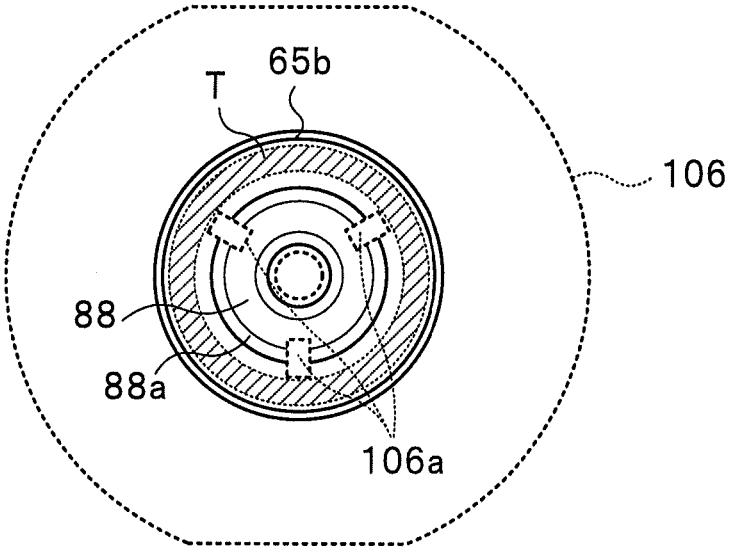
FIG. 8 is an illustration showing the positional relationship between projecting portions 106*a* of the upper die 106 and a spring receiving surface 65*b* of the piston 60 as seen from above.
Figure 9:
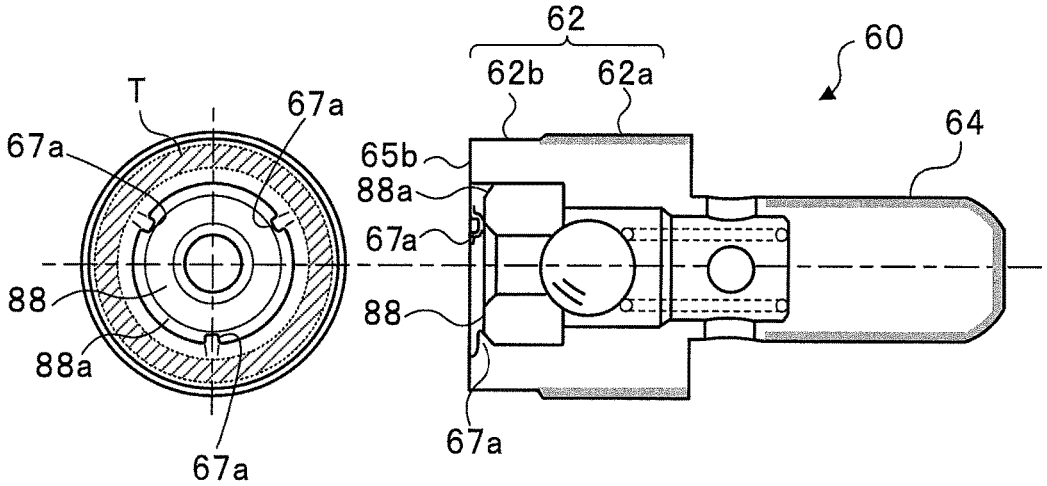
FIG. 9 is an illustration showing the piston 60 after being plastically deformed.

FIG. 6 shows how the piston 60 is plastically deformed. As shown in the drawing, the deformation is performed using a lower die 102 formed with a through hole 102*a* into which the shaft portion 64 of the piston 60 can be inserted, a cylindrical guide 104 with an inside diameter that allows the lower die 102 to be just fitted in the guide 104, and a cylindrical upper die 106 that can be driven by a drive portion (not shown) to move up and down within the guide 104. That is, first, the piston 60 is set onto the lower die 102 by inserting the shaft portion 64 of the piston 60 into which the discharge check valve 80 has been inserted into the through hole 102*a* with the end surface 65 facing upward. In this state, the drive portion is driven to move the upper die 106 downward within the guide 104 to press the spring receiving surface 65*b*, thereby the deformation is completed. A schematic configuration of the upper die 106 is shown in FIG. 7. As shown in FIG. 7, the upper die 106 is formed with three projecting portions 106*a* projecting from the lower surface of the upper die 106 and arranged at equal intervals in the circumferential direction about the axis of the upper die 106. The positional relationship between the projecting portions 106*a* of the upper die 106 and the spring receiving surface 65*b* of the piston 60 as seen from above is shown in FIG. 8. The piston 60 after the plastic deformation is shown in FIG. 9. As shown in FIG. 8, the projecting portions 106*a* are formed at positions at which the projecting portions 106*a* are provided inwardly of the abutment region T and generally the center of each of the projecting portions 106*a* is on the edge of the opening 65*a* when the upper die 106 faces the spring receiving surface 65*b* of the piston 60 set on the lower die 102. Therefore, the projecting portions 106*a* of the upper die 106 can partially press a portion of the spring receiving surface 65*b* of the piston 60 on the inner peripheral side with respect to the abutment region T.

Figure 10:
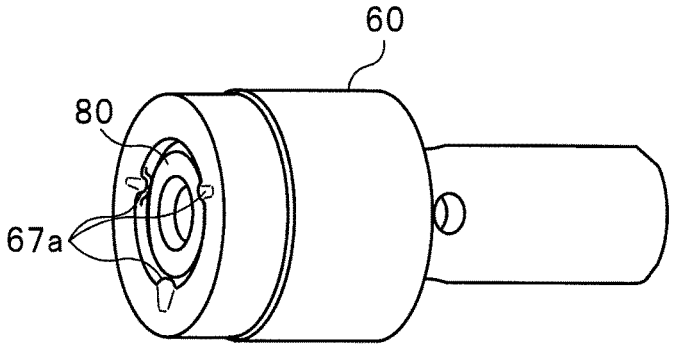
FIG. 10 shows the appearance of the discharge check valve 80 and the piston 60 after being assembled.

When the portion of the spring receiving surface 65*b* on the inner peripheral side with respect to the abutment region T is partially pressed, the piston 60 is plastically deformed such that the spring receiving surface 65*b* is recessed and the inner peripheral surface 67 is elevated to form three elevated portions 67*a* as shown in FIG. 9. In the embodiment, the elevated portions 67*a* are formed to flow into a gap between the inner peripheral surface 67 and the tapered surface 88*a* of the plug 88. The thus formed elevated portions 67*a* can regulate the plug 88 from moving toward the opening 65*a* (outer side). From the beginning, the plug 88 is press-fitted into the hollow portion 66 of the piston 60, and thus is not easily moved. However, forming the elevated portions 67*a* can reliably prevent the plug 88 from moving toward the opening 65*a* even in the case where an unexpected excessive force is applied to the plug 88. Fixing the discharge check valve 80 in this way can improve the ease of assembly of the electromagnetic pump 20 compared to a configuration in which the discharge check valve 80 is fixed using a relatively small member such as a snap ring. In addition, the number of parts can be reduced with no need for a dedicated fixing part. This is the reason that the discharge check valve 80 is fixed through plastic deformation of the piston 60 after the discharge check valve 80 is press-fitted into the hollow portion 66 of the piston 60. As discussed above, the piston 60 is quenched through high-frequency quenching such that the sliding portion 62*a* and the shaft portion 64 are quenched but the distal-end portion 62*b* is not quenched. Thus, the press-fitting of the plug 88 into the distal-end portion 62*b* and the plastic deformation discussed above can be performed relatively easily while the durability and the wear resistance of the sliding portion 62*a* and the shaft portion 64 are secured. In addition, the distal-end portion 62*b* is smaller in outside diameter than the sliding portion 62*a*. Thus, an increase in sliding resistance during sliding of the cylinder 50 can be prevented even if the piston 60 is expanded in outside diameter by the press-fitting of the plug 88 or the plastic deformation. In the embodiment, the discharge check valve 80 is assembled to the piston 60 in this way to form a sub-assembly (see FIG. 10).

The discharge check valve 80 opens with the spring 86 compressed and the ball 84 moved away from the center hole 89 of the plug 88 when the pressure difference (P2−P3) between the input-side pressure (pressure on the output side of the suction check valve 70) P2 and the output-side pressure P3 is equal to or more than a predetermined pressure to overcome the urging force of the spring 86. The discharge check valve 80 closes with the spring 86 expanded and the ball 84 pressed against the center hole 89 of the plug 88 to block the center hole 89 when the pressure difference (P2−P3) discussed above is less than the predetermined pressure.

In the cylinder 50, the pump chamber 56 is formed as a space surrounded by an inner wall 51, the distal-end surface of the piston 60, and a surface of the suction check valve 70 on the spring 46 side. When the piston 60 is moved by the urging force of the spring 46, the volume inside the pump chamber 56 is expanded to open the suction check valve 70 and close the discharge check valve 80 to suck working oil via the suction port 42. When the piston 60 is moved by the electromagnetic force of the solenoid portion 30, the volume inside the pump chamber 56 is reduced to close the suction check valve 70 and to open the discharge check valve 80 to discharge the sucked working oil via the discharge port 44.

The cylinder 50 is formed with a step between an inner wall 52, over which the sliding portion 62*a* of the piston main body 62 slides, and an inner wall 54, over which the shaft portion 64 slides. The discharge port 44 is formed at the stepped portion. The stepped portion forms a space surrounded by an annular surface of the stepped portion between the piston main body 62 and the shaft portion 64, and the outer peripheral surface of the shaft portion 64. The space is formed on the opposite side of the piston main body 62 from the pump chamber 56. Thus, the volume of the space is reduced when the volume of the pump chamber 56 is expanded, and expanded when the volume of the pump chamber 56 is reduced. In this event, variations in volume of the space are smaller than variations in volume of the pump chamber 56 because the area (pressure receiving area) over which the piston 60 receives a pressure from the pump chamber 56 side is larger than the area (pressure receiving area) over which the piston 60 receives a pressure from the discharge port 44 side. Therefore, the space serves as a second pump chamber 58. That is, when the piston 60 is moved by the urging force of the spring 46, an amount of working oil corresponding to the amount of expansion in volume of the pump chamber 56 is sucked from the suction port 42 into the pump chamber 56 via the suction check valve 70, and an amount of working oil corresponding to the amount of reduction in volume of the second pump chamber 58 is discharged from the second pump chamber 58 via the discharge port 44. When the piston 60 is moved by the electromagnetic force of the solenoid portion 30, an amount of working oil corresponding to the amount of reduction in volume of the pump chamber 56 is fed from the pump chamber 56 into the second pump chamber 58 via the discharge check valve 80, and an amount of working oil corresponding to the difference between the amount of reduction in volume of the pump chamber 56 and the amount of expansion in volume of the second pump chamber 58 is discharged via the discharge port 44. Thus, working oil is discharged from the discharge port 44 twice while the piston 60 moves back and forth once, which makes it possible to reduce discharge non-uniformities and improve the discharge performance.

Further, the cylinder 50 is formed with a step between the inner wall 51, which forms the pump chamber 56 defining the range of movement of the distal-end portion 62*b* of the piston main body 62, and the inner wall 52, over which the sliding portion 62*a* of the piston main body 62 slides, and the inside diameter of the inner wall 51 is larger than the inside diameter of the inner wall 52. As discussed above, the distal-end portion 62*b* is formed to be smaller in diameter than the sliding portion 62*a* so that the sliding resistance is not increased even if the piston 60 is expanded in outside diameter. However, it is still necessary to secure a necessary outside diameter (area) of the distal-end portion 62*b* in order for the spring receiving surface 65*b* to function as a spring receiver. Therefore, an expansion in outside diameter may not be handled by only the distal-end portion 62*b*, and a clearance between the distal-end portion 62*b* and the inner wall 51 is reliably secured by making the inside diameter of the inner wall 51 larger than the inside diameter of the inner wall 52. Consequently, an increase in sliding resistance can be reliably prevented even if the piston 60 is expanded in outside diameter by the press-fitting or the plastic deformation of the plug 88.

Figure 11:
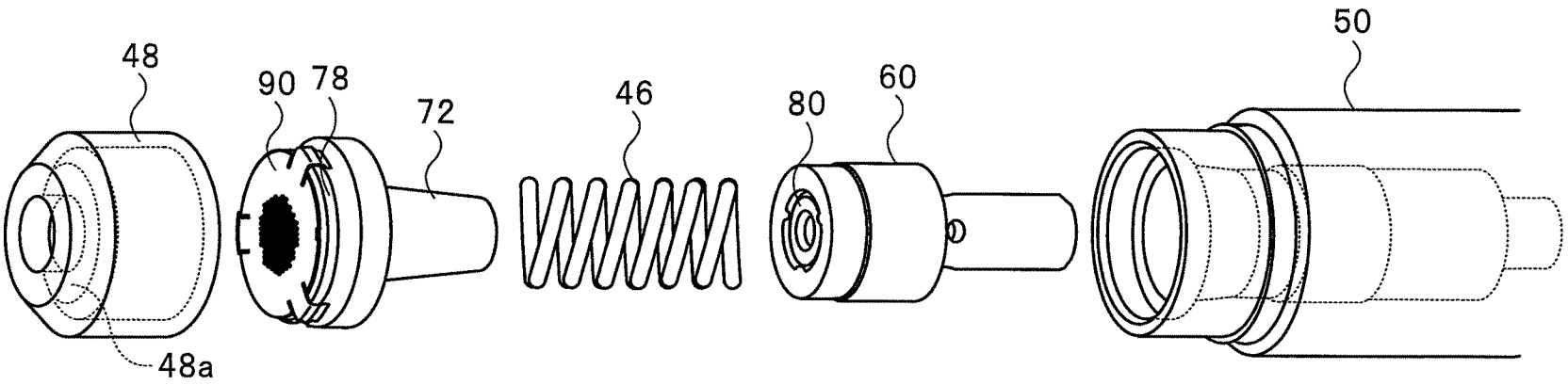
FIG. 11 is an illustration showing how the piston 60, the discharge check valve 80, a spring 46, the suction check valve 70, and a strainer 90 are assembled to a cylinder 50.

FIG. 11 illustrates how the electromagnetic pump 20 according to the embodiment is assembled. The electromagnetic pump 20 according to the embodiment is assembled by sequentially inserting the sub-assembly of the piston 60 and the discharge check valve 80, the spring 46, and the sub-assembly of the suction check valve 70 and the strainer 90 into the cylinder 50, and thereafter attaching the cylinder cover 48. The outer peripheral surface of the cylinder 50 and the inner peripheral surface of the cylinder cover 48 are engraved with spiral threads (not shown), and the cylinder cover 48 is attached by placing the cylinder cover 48 over the cylinder 50 and screwing the cylinder cover 48. When the cylinder cover 48 is attached, the outer peripheral edge of the strainer 90 is pressed by an annular pressing surface 48*a* of the cylinder cover 48 to fix the strainer 90.

With the electromagnetic pump 20 according to the embodiment described above, the discharge check valve 80 is fixed through plastic deformation of the piston 60 by inserting the constituent members of the discharge check valve 80 from the opening 65*a* of the piston 60 into the hollow portion 66, partially pressing a portion of the spring receiving surface 65*b* of the piston 60 on the inner peripheral side after the insertion, and recessing the spring receiving surface 65*b* and elevating the inner peripheral surface 67 surrounding the hollow portion 66. Thus, it is possible to improve the ease of assembly compared to a configuration in which the discharge check valve 80 is fixed using a relatively small member such as a snap ring, and to reduce the number of parts with no need for a dedicated fixing part. As a result, it is possible to reduce the number of parts and to further improve the ease of assembly of the electromagnetic pump 20.

A portion of the spring receiving surface 65*b* on the inner peripheral side with respect to the abutment region T is pressed. This hinders the abutment region T from being recessed significantly, which prevents the function of the piston 60 as a spring receiver from being affected. Further, quenching is performed except at the distal-end portion 62*b*. Thus, press-fitting and plastic deformation of the plug 88 can be performed relatively easily while a necessary hardness for the piston 60 is secured. Moreover, the distal-end portion 62*b* is smaller in outside diameter than the sliding portion 62*a*. Thus, an increase in sliding resistance during sliding of the cylinder 50 can be prevented even if the piston 60 is expanded in outside diameter by the press-fitting or the plastic deformation of the plug 88. In addition, the inside diameter of the inner wall 51 of the pump chamber 56, which defines the range of movement of the distal-end portion 62*b*, is formed to be larger than the inside diameter of the inner wall 52, over which the sliding portion 62*a* slides. Thus, it is possible to reliably secure a clearance between the outer peripheral surface of the distal-end portion 62*b* and the inner peripheral surface of the inner wall 51, which reliably prevents an increase in sliding resistance even if the piston 60 is expanded in outside diameter. Furthermore, the plug 88 is inserted into the hollow portion 66 with the tapered surface 88*a* facing toward the opening 65*a*. Thus, it is possible to fix the discharge check valve 80 more reliably with the elevated portions 67*a* in tight contact with the plug 88. The discharge check valve 80 may be fixed by the press-fitting of the plug 88 into the hollow portion 66 and by the elevated portions 67*a*. Thus, it is possible to reliably fix the discharge check valve 80 while suppressing deformation of the piston 60 compared to a configuration in which the discharge check valve 80 is fixed by only the elevated portions 67*a*.

In the electromagnetic pump 20 according to the embodiment, a portion of the spring receiving surface 65*b* on the inner side with respect to the abutment region T is pressed. However, an area inside the abutment region T may be pressed to such a degree that the function of the spring receiving surface 65*b* as a spring receiver is not impaired.

In the electromagnetic pump 20 according to the embodiment, high-frequency quenching is performed such that quenching is performed except at the distal-end portion 62*b* of the piston main body 62. However, any other method may be used as long as quenching is performed except at the distal-end portion 62*b*.

In the electromagnetic pump 20 according to the embodiment, the tapered surface 88*a* is formed on the plug 88. However, the tapered surface 88*a* may not be formed. In this case, an end surface of the plug 88 on the opening 65*a* side may enter the hollow portion 66 further than the spring receiving surface 65*b* of the piston 60 when the plug 88 is inserted into the hollow portion 66 of the piston 60, and the spring receiving surface 65*b* may be pressed such that the elevated portions 67*a* are elevated to extend over the end surface.

In the electromagnetic pump 20 according to the embodiment, the distal-end portion 62*b* of the piston 60 is made smaller in outside diameter than the sliding portion 62*a*, and the inner wall 51 of the cylinder 50 is made larger in inside diameter than the inner wall 52. However, the distal-end portion 62*b* may be the same in outside diameter as the sliding portion 62*a*, and the inner wall 51 may be the same in inside diameter as the inner wall 52.

In the electromagnetic pump 20 according to the embodiment, the plug 88 is press-fitted into the hollow portion 66 of the piston 60. However, the plug 88 may not be press-fitted into the hollow portion 66.

In the electromagnetic pump 20 according to the embodiment, the elevated portions 67*a* restrict movement of the plug 88. However, the elevated portions 67*a* may restrict movement of the constituent members of the discharge check valve 80 disposed on the opening 65*a* side. In addition, the constituent members of the discharge check valve 80 are inserted one by one. However, the discharge check valve assembled in advance as a sub-assembly may be inserted.

The electromagnetic pump 20 according to the embodiment is configured such that working oil is discharged from the discharge port 44 twice while the piston 60 moves back and forth once. However, the present invention is not limited thereto, and the electromagnetic pump 20 according to the embodiment may be any type of electromagnetic pump, such as a type in which working oil is sucked from the suction port into the pump chamber when the piston is moved forward by the electromagnetic force from the solenoid portion and the working oil in the pump chamber is discharged from the discharge port when the piston is moved backward by the urging force of the spring, and a type in which working oil is sucked from the suction port into the pump chamber when the piston is moved backward by the urging force of the spring and the working oil in the pump chamber is discharged from the discharge port when the piston is moved forward by the electromagnetic force from the solenoid portion.

The electromagnetic pump 20 according to the embodiment is used for a hydraulic control device that hydraulically drives clutches and brakes of an automatic transmission mounted on an automobile. However, the present invention is not limited thereto, and the electromagnetic pump 20 according to the embodiment may be applied to any system that transports fuel, transports a liquid for lubrication, or the like.

Here, the correspondence between the main elements of the embodiment and the main elements of the invention described in the "SUMMARY OF THE INVENTION" section will be described. In the embodiment, the piston 60 corresponds to the "piston". The solenoid portion 30 corresponds to the "electromagnetic portion". The spring 46 corresponds to the "spring". The hollow portion 66 corresponds to the "hollow portion". The spring receiving surface 65*b* corresponds to the "spring receiving surface". The ball 84 corresponds to the "ball". The plug 88 corresponds to the "plug". The spring 86 corresponds to the "second spring". The correspondence between the main elements of the embodiment and the main elements of the invention described in the "SUMMARY OF THE INVENTION" section does not limit the elements of the invention described in the "SUMMARY OF THE INVENTION" section, because the embodiment is an example given for the purpose of specifically describing the best mode for carrying out the invention described in the "SUMMARY OF THE INVENTION" section. That is, the invention described in the "SUMMARY OF THE INVENTION" section should be construed on the basis of the description in that section, and the embodiment is merely a specific example of the invention described in the "SUMMARY OF THE INVENTION" section.

While a mode for carrying out the present invention has been described above by way of an embodiment, it is a matter of course that the present invention is not limited to the embodiment in any way, and that the present invention may be implemented in various forms without departing from the scope and sprit of the present invention.

The present invention is applicable to the electromagnetic pump manufacturing industry and so forth.

The invention claimed is:

1. An electromagnetic pump comprising:

a piston that moves back and forth within a cylinder;

an electromagnetic portion that moves the piston forward;

and a spring that moves the piston backward, the piston including a discharge check valve built in the piston, wherein:

the piston is formed with a hollow portion that opens in an inner peripheral portion of an end surface of the piston, and a spring receiving surface formed on an outer peripheral portion of the end surface to receive the spring;

the discharge check valve is fixed through plastic deformation of the piston by inserting the discharge check valve into the hollow portion from an opening of the piston, and partially pressing a portion of the spring receiving surface of the piston on an inner peripheral side after the insertion to recess the spring receiving surface and elevate an inner peripheral surface of the piston surrounding the hollow portion causing portions of the inner peripheral surface of the piston to project inwardly towards a central axis of the piston, and the piston includes, on an outer peripheral surface of the piston, a distal-end portion that is formed continuously with the end surface of the spring receiving surface on an outer peripheral side and a sliding portion that is formed continuously with the distal-end portion and configured to enable sliding within the cylinder, and an outside diameter of the distal-end portion is smaller than that of the sliding portion.

2. The electromagnetic pump according to claim 1, wherein a portion of the spring receiving surface on the outer peripheral side is a region against which the spring abuts, and a portion of the spring receiving surface on the inner peripheral side with respect to the region is the portion that is pressed when inserting the discharge check valve.

3. The electromagnetic pump according to claim 1, wherein the piston is quenched except at an end portion of the piston having the end surface.

4. The electromagnetic pump according to claim 3, wherein the quenching is high-frequency quenching.

5. The electromagnetic pump according to claim 1, wherein the cylinder includes, on an inner peripheral side of the cylinder, a first inner wall that forms a pump chamber to accommodate the end surface of the piston and a second inner wall that is formed continuously with the first inner wall and over which the piston slides, and an inside diameter of the first inner wall is larger than that of the second inner wall.

6. The electromagnetic pump according to claim 1, wherein:

the piston is formed with a cylindrical space that communicates with a discharge port as the hollow portion;

the discharge check valve includes a ball, an annular plug formed with a flow-in port for a working fluid, and a second spring that presses the ball against the flow-in port of the plug in a direction opposite to a flow-in direction of the working fluid, which are inserted into the hollow portion of the piston in the order of the second spring, the ball, and the plug; and the inner peripheral surface surrounding the hollow portion is elevated by the pressing to extend over the plug.

7. The electromagnetic pump according to claim 6, wherein:

the plug is formed with a tapered surface that becomes gradually larger in outside diameter from an end surface toward an outer peripheral surface, and inserted into the hollow portion with the tapered surface facing toward the opening; and the inner peripheral surface surrounding the hollow portion is elevated by the pressing to fill a gap between the inner peripheral surface and the tapered surface of the plug.

8. The electromagnetic pump according to claim 6, wherein the plug is press-fitted into the hollow portion of the piston.

9. An electromagnetic pump comprising:

a piston that moves back and forth within a cylinder;

an electromagnetic portion that moves the piston forward;

and a spring that moves the piston backward, the piston including a discharge check valve built in the piston, wherein:

the piston is formed with a hollow portion that opens in an inner peripheral portion of an end surface of the piston, and a spring receiving surface formed on an outer peripheral portion of the end surface to receive the spring;

the discharge check valve is fixed through plastic deformation of the piston by inserting the discharge check valve into the hollow portion from an opening of the piston, and partially pressing a portion of the spring receiving surface of the piston on an inner peripheral side after the insertion to recess the spring receiving surface and elevate an inner peripheral surface of the piston surrounding the hollow portion causing portions of the inner peripheral surface of the piston to project inwardly towards a central axis of the piston, and the cylinder includes, on an inner peripheral side of the cylinder, a first inner wall that forms a pump chamber to accommodate the end surface of the piston and a second inner wall that is formed continuously with the first inner wall and over which the piston slides, and an inside diameter of the first inner wall is larger than an inside diameter of the second inner wall.

10. The electromagnetic pump according to claim 9, wherein a portion of the spring receiving surface on the outer peripheral side is a region against which the spring abuts, and a portion of the spring receiving surface on the inner peripheral side with respect to the region is the portion that is pressed when inserting the discharge check valve.

11. The electromagnetic pump according to claim 9, wherein the piston is quenched except at an end portion of the piston having the end surface.

12. The electromagnetic pump according to claim 11, wherein the quenching is high-frequency quenching.

13. The electromagnetic pump according to claim 9, wherein:

the piston is formed with a cylindrical space that communicates with a discharge port as the hollow portion;

the discharge check valve includes a ball, an annular plug formed with a flow-in port for a working fluid, and a second spring that presses the ball against the flow-in port of the plug in a direction opposite to a flow-in direction of the working fluid, which are inserted into the hollow portion of the piston in the order of the second spring, the ball, and the plug; and the inner peripheral surface surrounding the hollow portion is elevated by the pressing to extend over the plug.

14. The electromagnetic pump according to claim 13, wherein:

the plug is formed with a tapered surface that becomes gradually larger in outside diameter from an end surface toward an outer peripheral surface, and inserted into the hollow portion with the tapered surface facing toward the opening; and the inner peripheral surface surrounding the hollow portion is elevated by the pressing to fill a gap between the inner peripheral surface and the tapered surface of the plug.

15. The electromagnetic pump according to claim 13, wherein the plug is press-fitted into the hollow portion of the piston.

* * * * *